US010695818B2

(12) United States Patent
McClung et al.

(10) Patent No.: US 10,695,818 B2
(45) Date of Patent: Jun. 30, 2020

(54) CONTAINER, AND SELECTIVELY FORMED SHELL, AND TOOLING AND ASSOCIATED METHOD FOR PROVIDING SAME

(71) Applicant: Stolle Machinery Company, LLC, Centennial, CO (US)

(72) Inventors: James A. McClung, Canton, OH (US); Aaron E. Carstens, Centerville, OH (US); Gregory H. Butcher, Naples, FL (US); Paul L. Ripple, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 654 days.

(21) Appl. No.: 15/399,812

(22) Filed: Jan. 6, 2017

(65) Prior Publication Data

US 2017/0113261 A1 Apr. 27, 2017

Related U.S. Application Data

(63) Continuation of application No. 14/722,187, filed on May 27, 2015, now Pat. No. 9,975,164, and a continuation of application No. 13/894,017, filed on May 14, 2013, now Pat. No. 9,573,183.

(60) Provisional application No. 61/648,698, filed on May 18, 2012.

(51) Int. Cl.

| | |
|---|---|
| ***B21D 51/44*** | (2006.01) |
| ***B21D 51/26*** | (2006.01) |
| ***B21D 22/24*** | (2006.01) |
| ***B21D 51/38*** | (2006.01) |
| ***B21D 37/10*** | (2006.01) |

(52) U.S. Cl.

CPC ..... *B21D 51/44* (2013.01); *B21D 22/24* (2013.01); *B21D 37/10* (2013.01); *B21D 51/26* (2013.01); *B21D 51/2653* (2013.01); *B21D 51/38* (2013.01); *Y10T 428/12389* (2015.01)

(58) Field of Classification Search

CPC ..... B65D 7/36; B65D 17/08; B21D 51/44; B21D 51/38

See application file for complete search history.

(56) References Cited

U.S. PATENT DOCUMENTS

| | | | | |
|---|---|---|---|---|
| 3,957,005 A * | 5/1976 | Heffner | ..... | B21D 22/26 413/8 |
| 4,571,978 A | 2/1986 | Taube et al. | | |
| 4,574,608 A | 3/1986 | Bulso, Jr. et al. | | |

(Continued)

FOREIGN PATENT DOCUMENTS

| | | |
|---|---|---|
| CN | 1642671 | 7/2005 |
| CN | 1321862 | 6/2007 |

(Continued)

*Primary Examiner* — Jeffrey R Allen

(74) *Attorney, Agent, or Firm* — Eckert Seamans Cherin & Mellott, LLC

(57) ABSTRACT

A shell, a container employing the shell, and tooling and associated methods for forming the shell are provided. The shell includes a center panel, a circumferential chuck wall, an annular countersink between the center panel and the circumferential chuck wall, and a curl extending radially outwardly from the chuck wall. The material of at least one predetermined portion of the shell is selectively stretched relative to at least one other portion of the shell, thereby providing a corresponding thinned portion.

5 Claims, 5 Drawing Sheets

(56) References Cited

U.S. PATENT DOCUMENTS

| | | | | |
|---|---|---|---|---|
| 4,587,826 | A | 5/1986 | Bulso, Jr. et al. | |
| 4,713,958 | A | 12/1987 | Bulso, Jr. et al. | |
| 4,715,208 | A | 12/1987 | Bulso, Jr. et al. | |
| 4,716,755 | A | 1/1988 | Bulso, Jr. et al. | |
| 4,722,215 | A | 2/1988 | Taube et al. | |
| 4,808,052 | A | 2/1989 | Bulso, Jr. et al. | |
| 5,149,238 | A | 9/1992 | McEldowney et al. | |
| 6,336,780 | B1 * | 1/2002 | Chasteen ..... | B21D 51/38 413/56 |
| 6,386,013 | B1 | 5/2002 | Werth | |
| 2010/0059517 | A1 * | 3/2010 | An ..... | B65D 17/4011 220/269 |
| 2010/0242567 | A1 | 9/2010 | Nardini et al. | |
| 2012/0067102 | A1 | 3/2012 | Stodd | |
| 2013/0309043 | A1 | 11/2013 | McClung et al. | |

FOREIGN PATENT DOCUMENTS

| | | |
|---|---|---|
| DE | 29906170 | 4/1998 |
| EP | 0497346 | 1/1992 |
| JP | 60-193834 | 10/1985 |
| WO | 94/25197 | 11/1994 |
| WO | 2006015175 | 2/2006 |

* cited by examiner

CONTAINER, AND SELECTIVELY FORMED SHELL, AND TOOLING AND ASSOCIATED METHOD FOR PROVIDING SAME

CROSS-REFERENCE TO RELATED APPLICATION

This application is a continuation patent application of U.S. patent application Ser. No. 13/894,017, filed May 14, 2013, which application claims the benefit of U.S. Provisional Patent Application Ser. No. 61/648,698, filed May 18, 2012, entitled "CONTAINER, AND SELECTIVELY FORMED SHELL, AND TOOLING AND ASSOCIATED METHOD FOR PROVIDING SAME," which is hereby incorporated by reference as if fully set forth herein. This application further claims priority to U.S. patent application Ser. No. 14/722,187, filed May 27, 2015, entitled "CONTAINER, AND SELECTIVELY FORMED SHELL, AND TOOLING AND ASSOCIATED METHOD FOR PROVIDING SAME."

BACKGROUND

Field

The disclosed concept relates generally to containers and, more particularly, to can ends or shells for metal containers such as, for example, beer or beverage cans, as well as food cans. The disclosed concept also relates to methods and tooling for selectively forming a can end or shell to reduce the amount of material used therein.

Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

When the can end is made, it originates as a can end shell, which is formed from a blank cut (e.g., blanked) from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press.

In the can making industry, large volumes of metal are required in order to manufacture a considerable number of cans. Thus, an ongoing objective in the industry is to reduce the amount of metal that is consumed. Efforts are constantly being made, therefore, to reduce the thickness or gauge (sometimes referred to as "down-gauging") of the stock material from which can ends and can bodies are made. However, as less material (e.g., thinner gauge) is used, problems arise that require the development of unique solutions. There is, therefore, a continuing desire in the industry to reduce the gauge and thereby reduce the amount of material used to form such containers. However, among other disadvantages associated with the formation of can ends from relatively thin gauge material, is the tendency of the can end to wrinkle, for example, during forming of the shell.

Prior proposals for reducing the volume of metal used reduce the blank size for the can end, but sacrifice the area of the end panel. This undesirably limits the available space, for example, for the scoreline, the severable panel and/or the pull tab.

There is, therefore, room for improvement in containers such as beer/beverage cans and food cans, as well as in selectively formed can ends or shells and tooling and methods for providing such can ends or shells.

SUMMARY

These needs and others are met by the disclosed concept, which is directed to a selectively formed shell, a container employing the selectively formed shell, and tooling and associated methods for making the shell. Among other benefits, the shell is selectively stretched and thinned to reduce the amount of metal required while maintaining the desired strength.

As one aspect of the disclosed concept, a shell is structured to be affixed to a container. The shell comprises: a center panel; a circumferential chuck wall; an annular countersink between the center panel and the circumferential chuck wall; and a curl extending radially outwardly from the chuck wall. The material of at least one predetermined portion of the shell is selectively stretched relative to at least one other portion of the shell, thereby providing a corresponding thinned portion.

The shell may be formed from a blank of material, wherein the blank of material has a base gauge prior to being formed, and wherein, after being formed, the material of the shell at or about the thinned portion has a thickness. The thickness of the material at or about the thinned portion is less than the base gauge. The thinned portion may include the chuck wall.

As another aspect of the disclosed concept, a method is provided for forming a shell. The method comprises: introducing material between tooling, forming the material to include a center panel, a circumferential chuck wall, an annular countersink between the center panel and the circumferential chuck wall, and a curl extending radially outwardly from the chuck wall, and selectively stretching at least one predetermined portion of the shell relative to at least one other portion of the shell to provide a corresponding thinned portion of the shell.

The method may comprise the step of converting the shell into a finished can end. The method may further comprise the step of seaming the finished can end onto a container body.

As a further aspect of the disclosed concept, tooling is provided for forming a shell. The tooling comprises: an upper tool assembly; and a lower tool assembly cooperating with the upper tool assembly to form material disposed therebetween to include a center panel, a circumferential chuck wall, an annular countersink between the center panel and the circumferential chuck wall, and a curl extending radially outwardly from the chuck wall. The upper tool assembly and the lower tool assembly cooperate to selectively stretch the material of at least one predetermined portion of the shell relative to at least one other portion of the shell, thereby providing a corresponding thinned portion.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
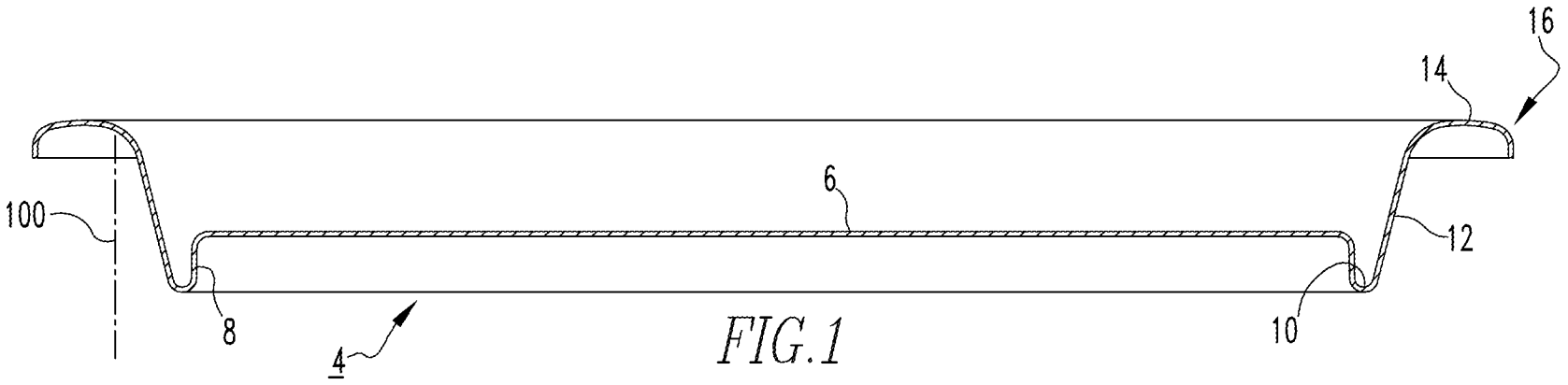
FIG. 1 is a side elevation section view of a shell for a beverage can end, also showing a portion of a beverage can in simplified form in phantom line drawing.

For purposes of illustration, embodiments of the disclosed concept will be described as applied to shells for a can end known in the industry as a "B64" end, although it will become apparent that they could also be employed to suitably selectively stretch and thin predetermined portions or areas of any known or suitable alternative type (e.g., without limitation, beverage/beer can ends; food can ends) and/or configuration other than B64 ends.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, left, right, upward, downward, top, bottom, upper, lower and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the terms "tooling," "tooling assembly" and "tool assembly" are used substantially interchangeably to refer to any known or suitable tool(s) or component(s) used to form (e.g., without limitation, stretch) shells in accordance with the disclosed concept.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
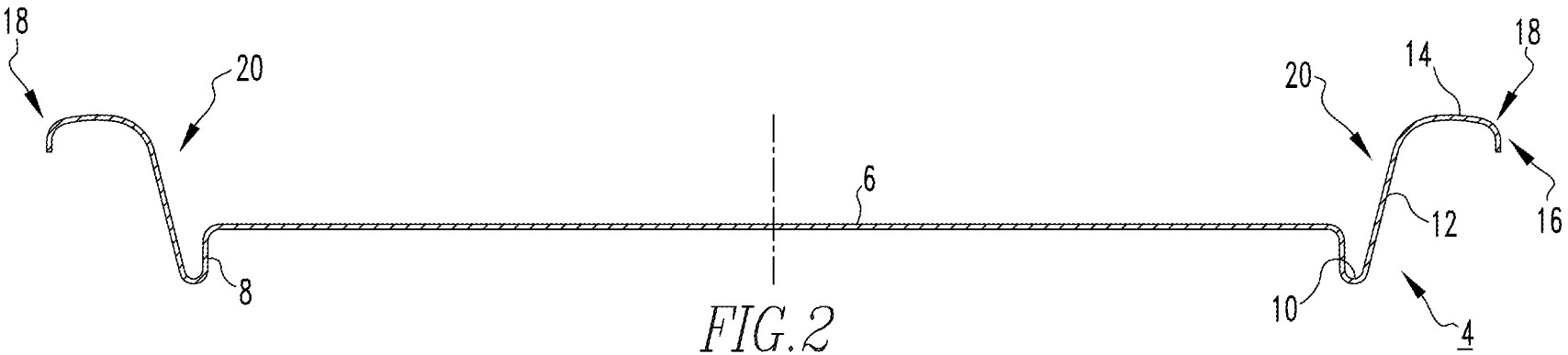
FIG. 2 is a side elevation section view of the shell of FIG. 1, showing various thinning locations, in accordance with one non-limiting aspect of the disclosed concept.

FIGS. 1 and 2 show a can end shell 4 that is selectively formed in accordance with one non-limiting example embodiment of the disclosed concept. Specifically, as described in detail hereinbelow, the material in certain predetermined areas of the shell 4, has been stretched, thereby thinning it, whereas other areas of the shell 4 preferably maintain the base metal thickness. Although the example shown and described herein refers to a shell (see, for example and without limitation, shell 4 of FIGS. 1-3, 5 and 6E) for a beverage can 100 (partially shown in simplified form in phantom line drawing in FIG. 1), it will be appreciate that the disclosed concept could be employed to stretch and thin any known or suitable can end shell type and/or configuration for any known or suitable alternative type of container (e.g., without limitation, food can (not shown)), which is subsequently further formed (e.g., converted) into a finished can end for such a container.

The shell 4 in the non-limiting example shown and described herein includes a circular center panel 6, which is connected by a substantially cylindrical panel wall 8 to an annular countersink 10. The example annular countersink 10 has a generally U-shaped cross-sectional profile. A tapered chuck wall 12 connects the countersink 10 to a crown 14, and a peripheral curl or outer lip 16 extends radially outwardly from the crown 14, as shown in FIGS. 1, 2 and 6E.

In the non-limiting example of FIG. 2, the shell 4 has a base metal thickness of about 0.0082 inch. This base metal thickness is preferably substantially maintained in areas such as the center panel 6 and outer lip or curl 16. Keeping the center panel 6 in the base metal thickness helps with rivet, score and tab functions in the converted end (not explicitly shown). For example and without limitation, undesirable issues such as wrinkling and/or undesired scoreline and/or rivet or tab failures that can be attributed to reduced strength associated with thinned metal, are substantially eliminated by substantially maintaining the base thickness in the panel 6. Similarly, substantially maintaining the outer lip 16 at base gauge helps with the seaming ability, for seaming the lid or can end shell 4 to the can body 100 (partially shown in simplified form in phantom line drawing in FIG. 1). This area where preferably minimal to no thinning occurs, is indicated generally in FIG. 2 by reference 18.

Accordingly, the majority of the thinning (e.g., without limitation, between 10-20% thinning) preferably occurs in the chuck wall 12. More specifically, thinning preferably occurs in the area between the crown 14 and the countersink 10, which is generally indicated as area 20 in FIG. 2. Thus, by way of illustration, in the non-limiting example of FIG. 2, the thickness of the material in the chuck wall 12 may be reduced to about 0.0065 inch. It will be appreciated that this is a substantial reduction, which results in significant weight reduction and cost savings over conventional can ends.

It will further be appreciated that the particular shell type and/or configuration and/or dimensions shown in FIG. 2 (and all of the figures provided herein) are provided solely for purposes of illustration and are not limiting on the scope of the disclosed concept. That is, any known or suitable alternative thinning of the base gauge could be implemented in additional and/or alternative areas of the shell (e.g., without limitation, 4) for any known or suitable shell, or end type and/or configuration, without departing from the scope of the disclosed concept.

Moreover, the disclosed concept achieves material thinning and an associated reduction in the overall amount and weight of material, without incurring increased material processing charges associated with the stock material that is supplied to form the end product. For example and without limitation, increased processing (e.g., rolling) of the stock material to reduce the base gauge (i.e., thickness) of the material can undesirably result in a relatively substantial increase in initial cost of the material. The disclosed concept achieves desired thinning and reduction, yet uses stock material having a more conventional and, therefore, less expensive base gauge.

Figure 3:
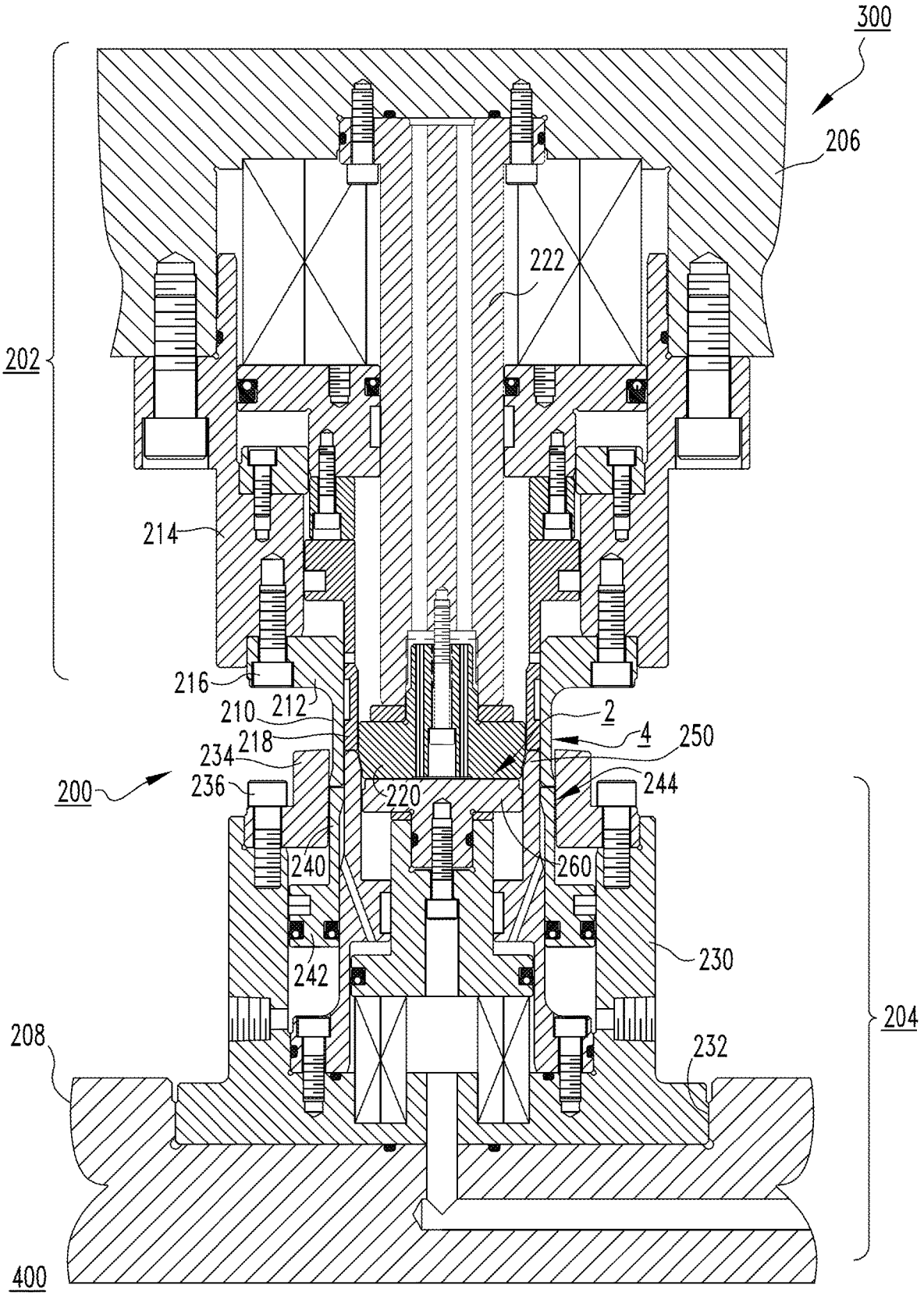
FIG. 3 is a side elevation section view of tooling in accordance with an embodiment of the disclosed concept.
Figure 4:
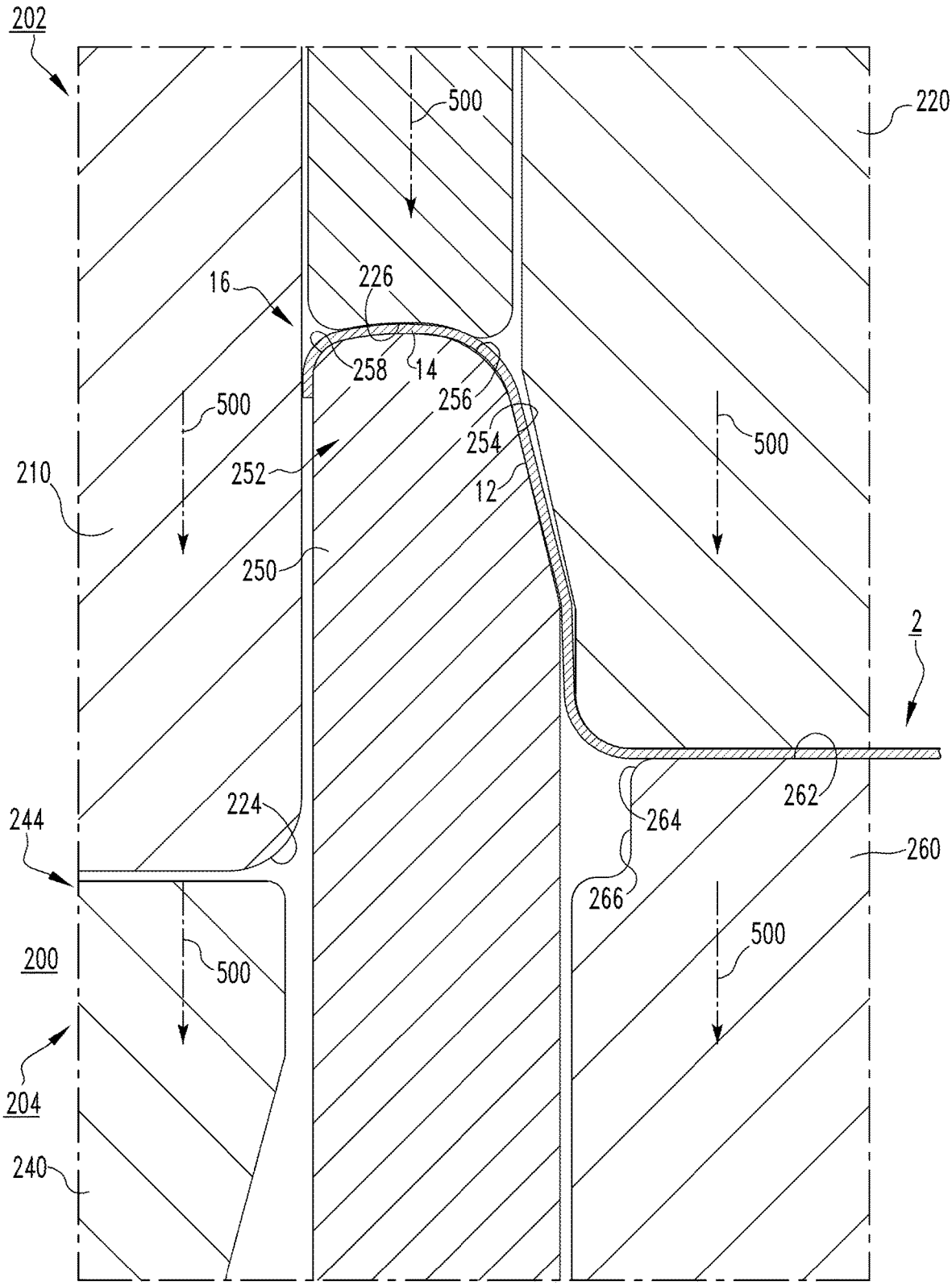
FIG. 4 is a side elevation section view of a portion of the tooling of FIG. 3.
Figure 5:
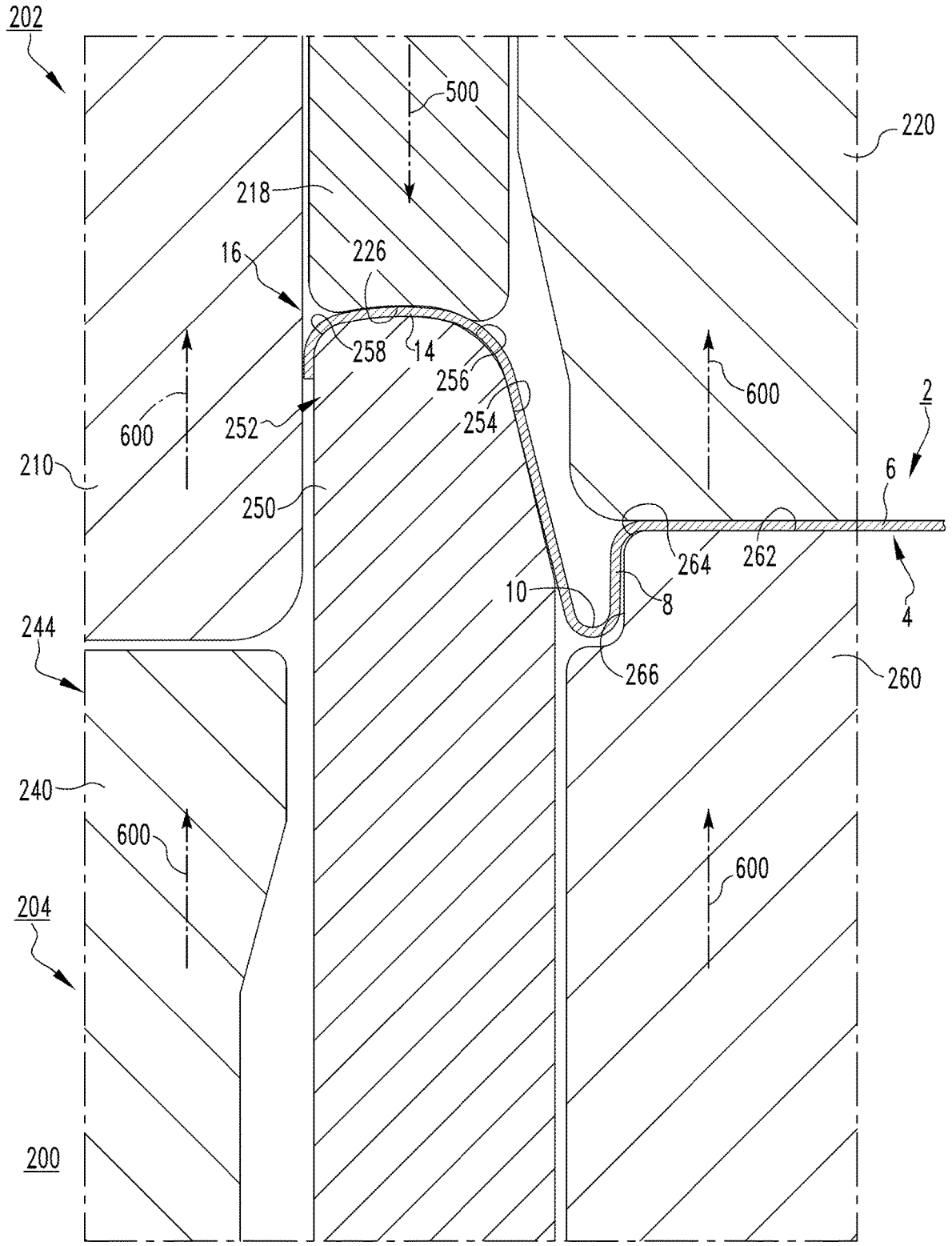
FIG. 5 is a side elevation section view of the portion of the tooling of FIG. 4, modified to show the tooling in a different position, in accordance with a non-limiting example forming method of the disclosed concept.

FIGS. 3-5 show various tooling 200 for stretching and thinning the shell material, in accordance with one non-limiting example embodiment of the disclosed concept. Specifically, the selective forming (e.g., stretching and thinning) is accomplished by way of precise tooling geometry, placement and interaction. In accordance with one non-limiting embodiment, the process begins by introducing a blank of material (see, for example and without limitation, blank 2 of FIG. 6A) having a base metal thickness or gauge, between components of a tooling assembly 200.

FIG. 3 illustrates a single station 300 of a multiple station tooling assembly 200 coupled to a press 400. For example and without limitation, typically one shell 4 is produced at each station 300 during each stroke of a conventional high-speed single-action or double-action mechanical press 400 to which the multiple station tooling assembly 200 of the disclosed concept is coupled. The tooling assembly 200 includes opposing upper and lower tool assemblies 202,204 that cooperate to form (e.g., without limitation, stretch; thin; bend) metal (see, for example and without limitation, metal blank 2 of FIG. 6A) to achieve the desired shell (see, for example, and without limitation, shell 4 of FIGS. 1-3, 5 and 6E), in accordance with the disclosed concept.

More specifically, the upper and lower tool assemblies 202,204 are coupled to upper and lower die shoes 206,208, which are respectively supported by the press bed and/or bolster plates and the ram within the press 400 in a generally well known manner. An annular blank and draw die 210 includes an upper flange portion 212, which is coupled to a retainer or riser body 214 by a number of fasteners 216. The blank and draw die 210 surrounds an upper pressure sleeve 218. That is, the blank and draw die 210 is proximate to the upper pressure sleeve 218 and is located radially outward from the upper pressure sleeve 218. An inner die member or die center 220 is supported within the upper pressure sleeve 218 by a die center riser 222. The blank and draw die 210 includes an inner curved forming surface 224 (FIGS. 4 and 5). The lower end of the upper pressure sleeve 218 includes a contoured annular forming surface 226 (FIGS. 4 and 5).

Continuing to refer to FIG. 3, an annular die retainer 230 is coupled to the lower die shoe 208 within a counterbore 232. An annular cut edge die 234 is coupled to the die retainer 230 by suitable fasteners 236. An annular lower pressure sleeve 240 includes a lower piston portion 242 for movement within the die retainer 230. The lower pressure sleeve 240 further includes an upper end 244 having a substantially flat surface which opposes the lower end of the aforementioned blank and draw die 210. The cut edge die 234 is located proximate to the lower pressure sleeve 240 and radially outward from the upper end 244 of the lower pressure sleeve 240, as shown. A die core ring 250 is disposed within the lower pressure sleeve 240, and includes an upper end 252 that opposes the lower end or forming surface 224 of the upper pressure sleeve 218, as best shown in FIGS. 4 and 5. The upper end 252 includes a tapered surface 254, a rounded inner surface 256 and a rounded outer surface 258 (all shown in FIGS. 4 and 5). A circular panel punch 260 is disposed within the die core ring 250 opposite the aforementioned die center 220. The panel punch 260 includes a circular, substantially flat upper surface 262 having a peripheral rounded surface 264. A peripheral recessed portion 266 extends downwardly from the rounded surface 264, as best shown in FIGS. 4 and 5.

Accordingly, the foregoing tools of the upper tool assembly 202 and lower tool assembly 204 cooperate to form and, in particular, stretch and thin predetermined selected areas of, the shell 4, as will now be described in greater detail with respect to FIGS. 6A-6E, which illustrate the method and associated forming stages for forming the stretched and thinned shell 4, in accordance with one non-limiting embodiment of the disclosed concept.

Figure 6A:
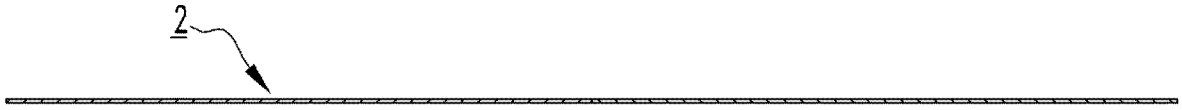
FIGS. 6A-6E are side elevation views of consecutive forming stages for forming a shell, in accordance with a non-limiting example embodiment of the disclosed concept.
Figure 6B:
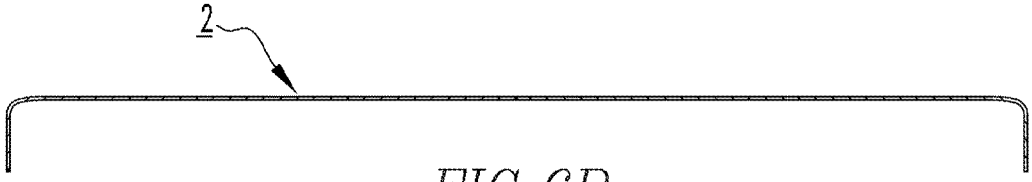
Figure 6C:
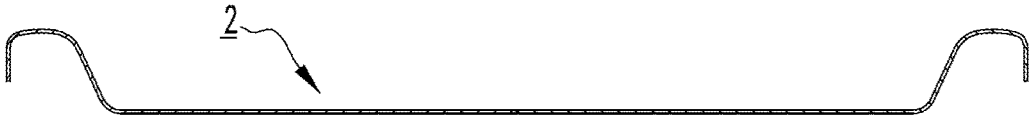

FIG. 6A shows a first forming step wherein a blank 2 is provided using the aforementioned tooling 200 (FIGS. 3-5). More specifically, respective cut edges of the blank and draw die 210 and annular cut edge die 234 cooperate to cut (e.g., blank) the blank 2, for example, from a web or sheet of material. In a second step, shown in FIG. 6B, the tooling 200 cooperates to make a first bend, namely bending the peripheral edges of the blank 2 downward, as shown. Next, in the forming step shown in FIG. 6C, the outer portions of the blank 2 are further formed, as shown. This is achieved by the inner rounded surface 224 of the blank and draw die 210 cooperating with the upper end 252 of the die core ring 250, and by the forming surface 226 of the upper pressure sleeve 218 cooperating with the upper end 252 of the die core ring 250.

Figure 6D:
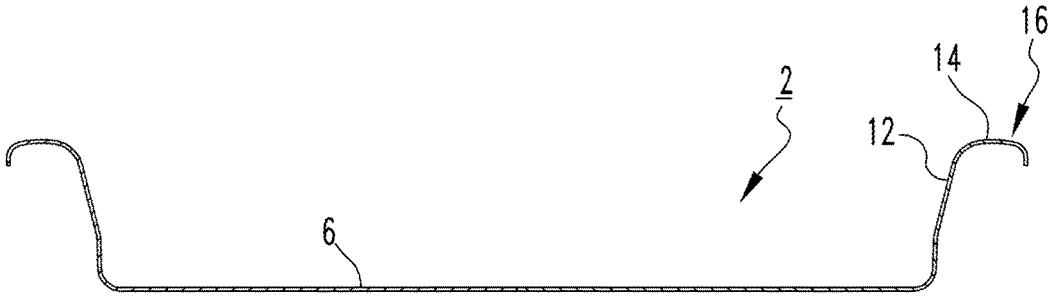
Figure 6E:
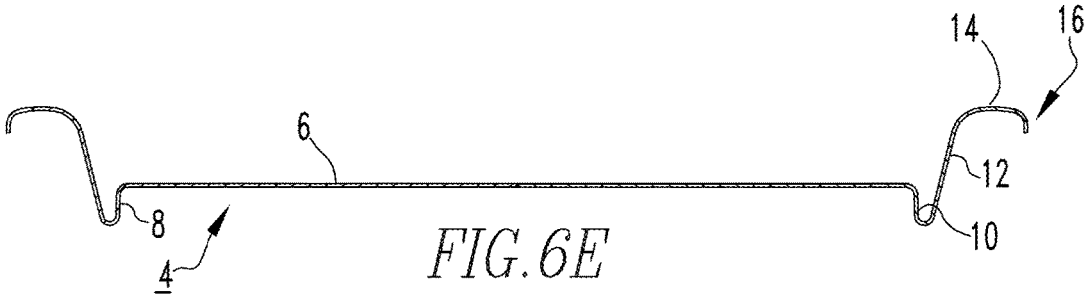

Stretching and thinning in accordance with the aforementioned non-limiting embodiment of the disclosed concept will be further described and understood with reference to the fourth forming step, illustrated in FIGS. 4 and 6D. Specifically, FIG. 4 shows the tooling 200 after a down stroke, wherein all of the tools shown have moved downward in the direction of arrows 500 to the positions shown. That is, the blank and draw die 210 and lower pressure sleeve 240 have moved downward in the direction of arrows 500 to further form the outer lip or curl 16. The upper pressure sleeve 218 has also moved downward in the direction of arrow 500, such that the forming surface 226 of the upper pressure sleeve 218 cooperates with the upper end 252 of the die core ring 250 to further form the crown 14, as shown. The die center 220, which also moves downward in the direction of arrow 500, stretches the metal of the blank 2 in the area of the chuck wall 12 as the substantially flat surface of the lower end of the die center 220 clamps the material between the die center 220 and the substantially flat upper surface 262 of the panel punch 260. The die center 220 and panel punch 260 both move downward in the direction of arrows 500 to stretch and thin the metal in the area of the chuck wall 12 as it cooperates with the tapered surface 254 of the die core ring 250. Thus, in the fourth forming step, the material of the blank 2 is stretched and thinned in the area that will become the chuck wall 12, but little to no stretching or thinning occurs in the outer lip or curl area 16, or in the area that will be later formed into the panel 6 (FIGS. 5 and 6E) or in the lower area that will be later formed into the annular countersink 10 (FIGS. 5 and 6E). These areas remain substantially at base gauge metal thickness, as previously discussed hereinabove.

In the fifth and final shell forming step, formation of the shell 4 is completed. Specifically, as shown in FIG. 5, which illustrates the same tooling 200 shown and described hereinabove with respect to the downward stroke of FIG. 4, some of the tooling 200 has moved upward in FIG. 5 in the direction of arrows 500 to form the panel 6 of the shell 4. Specifically, the blank and draw die 210, die center 220, lower pressure sleeve 240, and panel punch 260 all move upward in the direction of arrow 500, whereas the upper pressure sleeve 218 has stopped moving downward in the direction of arrow 500 at this point and is holding pressure on the shell 4. This results in the further formation of the outer lip or curl 16 over the rounded outer surface 258 of the die core ring 250, as well as the further formation of the crown 14 between the forming surface 226 of the upper pressure sleeve 218 and the upper end 252 of the die core ring 250. The desired final form of the chuck wall 12 is provided by interaction of the upper pressure sleeve 218 and surfaces 254 and 256 of the die core ring 250. The panel 6 is formed by interaction of the substantially flat upper surface 262 of the panel punch 260 with the die center 220 as both of these components move upward in the direction of arrows 600 with the metal of the blank 2 that becomes the panel 6 disposed (e.g., clamped) therebetween. This movement also facilitates the formation of the cylindrical panel wall 8 and countersink 10. Specifically, as the panel punch 260 moves upward and the upper pressure sleeve 218 moves downward, the annular countersink 10 is formed within the peripheral recessed portion 266 of the panel punch 260. The cylindrical panel wall 8 is, therefore, formed as the metal cooperates with the peripheral rounded surface 264 of the panel punch 260.

Accordingly, it will be appreciated that the disclosed concept differs substantially from conventional shell forming methods and tooling, wherein the material of the blank 2 or shell 4 is not specifically stretched or thinned. That is, while the panel 6, countersink 10 and outer lip or curl 16 portions of the example shell 4 (FIGS. 1-3, 5 and 6E) are not stretched or are nominally stretched, whereas the area 20 (FIG. 2) between the countersink 10 and crown 14 is stretched and thinned during the forming process and, in particular in the fourth forming step shown in FIGS. 5 and 6D.

It will be appreciated that while five forming stages are shown in FIGS. 6A-6E, that any known or suitable alternative number and/or order of forming stages could be performed to suitably selectively stretch and thin material in accordance with the disclosed concept. It will further be appreciated that any known or suitable mechanism for sufficiently securing certain areas of the material to resist movement (e.g., sliding) or flow or thinning of the material while other predetermined areas of the material are stretched and thinned could be employed, without departing from the scope of the disclosed concept. Moreover, alternative, or additional, areas of the shell (e.g., without limitation, 4) other than those which are shown and described herein could be suitably stretched and thinned, and the disclosed concept could be applied to stretch shells that are of a different type and/or configuration altogether (not shown).

Accordingly, it will be appreciated that the disclosed concept provides tooling 200 (FIGS. 3-5) and methods for selectively stretching and thinning predetermined areas (see, for example and without limitation, area 20 of FIG. 2) of a shell 4 (FIGS. 1-3, 5 and 6E), thereby providing relatively substantially material and cost savings.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A shell structured to be affixed to a container, the shell comprising:

a center panel, a circumferential chuck wall, an annular countersink between the center panel and the circumferential chuck wall, and a curl extending radially outwardly from the chuck wall and including an outer lip, wherein the shell is formed from a blank of material having a base gauge prior to being formed, wherein the material of at least one predetermined portion of the shell is selectively stretched relative to at least one other portion of the shell, thereby providing a corresponding thinned portion, wherein, after being formed, the material of the shell at or about the thinned portion has a thickness less than the base gauge, wherein the material of the shell at or about the outer lip has a thickness substantially the same as the base gauge, and wherein the thinned portion includes the chuck wall.

2. The shell of claim 1 wherein the material of the shell at or about the center panel has a thickness; and wherein the thickness at or about the center panel is substantially the same as the base gauge.

3. The shell of claim 1 wherein the material of the shell at or about the annular countersink has a thickness; and wherein the thickness at or about the annular countersink is substantially the same as the base gauge.

4. The shell of claim 1 further comprising a crown between the chuck wall and the curl.

5. The shell of claim 1 in combination with a container.

* * * * *